US009070503B2

(12) United States Patent
You et al.

(10) Patent No.: US 9,070,503 B2
(45) Date of Patent: Jun. 30, 2015

(54) DRY TYPE ECONOMIZER

(71) Applicant: SHUN-FU TECHNOLOGY CORP., Taipei (TW)

(72) Inventors: Ming-Shun You, Taipei (TW); Huan-Yu Chou, Taipei (TW)

(73) Assignee: SHUN-FU TECHNOLOGY CORP., Taipei (TW)

( * ) Notice: Subject to any disclaimer, the term of this patent is extended or adjusted under 35 U.S.C. 154(b) by 6 days.

(21) Appl. No.: 14/037,237

(22) Filed: Sep. 25, 2013

(65) Prior Publication Data

US 2015/0084728 A1 Mar. 26, 2015

(51) Int. Cl.

| | |
|---|---|
| ***H01F 27/08*** | (2006.01) |
| ***H01F 27/29*** | (2006.01) |
| ***H01F 27/28*** | (2006.01) |
| ***H01F 27/06*** | (2006.01) |

(52) U.S. Cl.

CPC ..... *H01F 27/2876* (2013.01); *H01F 27/06* (2013.01)

(58) Field of Classification Search

CPC ..... H01F 36/00; H01F 27/2876; H01F 27/08; H01F 27/22

USPC ..... 336/55, 60, 61, 221, 192

See application file for complete search history.

(56) References Cited

U.S. PATENT DOCUMENTS

| | | | | | |
|---|---|---|---|---|---|
| 3,037,177 | A * | 5/1962 | Marsh et al. | 336/210 |
| 3,264,590 | A * | 8/1966 | Trench | 336/60 |
| 5,267,393 | A * | 12/1993 | Purohit et al. | 29/605 |
| 5,682,292 | A * | 10/1997 | Salanki | 361/699 |
| 6,160,464 | A * | 12/2000 | Clarke et al. | 336/60 |
| 6,368,530 | B1 * | 4/2002 | Adubato et al. | 264/154 |
| 2010/0039212 | A1 * | 2/2010 | Matsumoto | 338/260 |
| 2012/0126923 | A1 * | 5/2012 | Navarro et al. | 336/5 |

FOREIGN PATENT DOCUMENTS

| | | | |
|---|---|---|---|
| CN | 2624496 | Y * | 7/2004 |
| EP | 2615616 | A2 * | 7/2013 |
| TW | M447475 | | 2/2013 |

* cited by examiner

*Primary Examiner* — Alexander Talpalatski
*Assistant Examiner* — Joselito Baisa
(74) *Attorney, Agent, or Firm* — Guice Patents PLLC

(57) ABSTRACT

A dry type economizer includes an economizing unit formed of a plurality of bodies, each body including a silicon-steel layer, an insulating layer surrounding the silicon-steel layer, a plurality of windings surrounding the insulating layer, and reactance elements and reactance filter converters respectively electrically connected to the windings, each winding being formed of a wire material having an increased wire diameter larger than a standard wire diameter of 3.5 mm. Thus, each body eliminates the use of any insulating oil, and has an increased volume to provide a large surface area in contact with the atmosphere for quick dissipation of heat during operation of the reactance elements.

4 Claims, 6 Drawing Sheets

A-A

DRY TYPE ECONOMIZER

BACKGROUND OF THE INVENTION

1. Field of the Invention:

The present invention relates to economizers for power-supply optimization, and more particular, to a dry type economizer, which eliminates the use of any insulating oil for heat dissipation, preventing component degradation.

2. Description of the Related Art:

An economizer is a mechanical device to be used for power-supply optimization during power conversion for energy efficiency. An economizer eliminates excess electricity by: absorbing reactive power through a reactance effect, restricting the access point over-voltage, removing noises and harmonic waves from the delivering power supply to eliminate unnecessary electromagnetic induction. Thus, an economizer can make full use of clean, high-load electricity, saving electricity costs and prolonging equipment lifespan.

In the reactance filter circuit structure of a conventional economizer, multi-stage switching devices are used for controlling different power factors. During operation of the reactance elements and switching devices, the electronic circuit will generate a large amount of heat, and therefore a cooling operation is necessary to lower the temperature.

Taiwan utility model patent M447475, issued to the present inventor, discloses an economizer entitled "Self-cooled economizer". As illustrated in FIG. 1 and FIG. 2, this design of self-cooled economizer comprises a body 10, a plurality of guide tubes 11 located at two opposite lateral sides of the body 10 and arranged in two rows at different elevations, and multiple sets of radiation fins 12 arranged at each of the two opposite lateral sides of the body 10 between the two rows of guide tubes 11, an electrical insulating oil 13 enclosed in the body 10, an economizing unit 14 mounted in the body 10 and surrounded by the electrical insulating oil 13, and an input casing 15 and an output casing 16 respectively electrically connected to the economizing unit 14 and extended out of the top wall of the body 10. Further, the economizing unit 14 has built therein a plurality of reactance elements (not shown) electrically connected to respective filter converters (not shown) that are electrically connected to switch means. The electrical insulating oil 13 fills up the internal space of the body 10 and the guide tubes 11 to work with the multiple sets of radiation fins 12 for heat dissipation. The self-cooled economizer further comprises a switch unit 17 mounted in a control zone at an outside wall of the body 10, and other electrical insulating oil fitting components, such as drain valve 18 and oil level meter 19. Through the aforesaid structural arrangement, the self-cooled economizer achieves heat dissipation and power-supply optimization.

However, the use of the electrical insulating oil 13, drain valve 18 and oil level meter 19 greatly complicates the operation and control of the economizer. The internal electrical insulating oil 13 can absorb oxygen and moisture from the air to produce grease stain, increasing the water content and causing components degradation.

SUMMARY OF THE INVENTION

The present invention has been accomplished under the circumstances in view. It is one object of the present invention to provide a dry type economizer, which eliminates the use of any insulating oil.

It is another object of the present invention to provide a dry type economizer, which eliminates the use of any insulating oil to prevent the internal components from degradation.

To achieve these and other objects of the invention, a dry type economizer comprises at least one economizing unit. Each economizing unit comprises a plurality of bodies, and two silicon-steel beams respectively mounted at opposing top and bottom sides of the bodies. Each body comprises a silicon-steel layer, an insulating layer surrounding the silicon-steel layer, and a plurality of windings surrounding the insulating layer and adapted for energizing reactance elements and reactance filter converters. Each winding is formed of a wire material having an increased wire diameter larger than a standard wire diameter of 3.5 mm. Preferably, the increasing rate in wire diameter of the windings is within the range of 50%~60% when compared to the standard wire diameter of 3.5 mm. Thus, each body eliminates the use of any insulating oil, and has an increased volume to provide a large surface area in contact with the atmosphere for quick dissipation of heat during operation of the reactance elements.

Preferably, each body of each economizing unit further comprises an external fitting structure located at the periphery thereof at one side and holding a plurality of reactance elements and reactance filter converters.

Preferably, the external fitting structure comprises a plurality of reactance element input/output casings, and a plurality of filter converter devices for use as reactance filter converters.

Preferably, the reactance element input/output casings are equally spaced in a line, and the filter converter devices are respectively disposed between each two adjacent reactance element input/output casings.

Further, the reactance element input/output casings and the filter converter devices are electrically connected in such a manner that the reactance element input/output casings and the filter converter devices are respectively and electrically connected to the windings of the respective said body.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
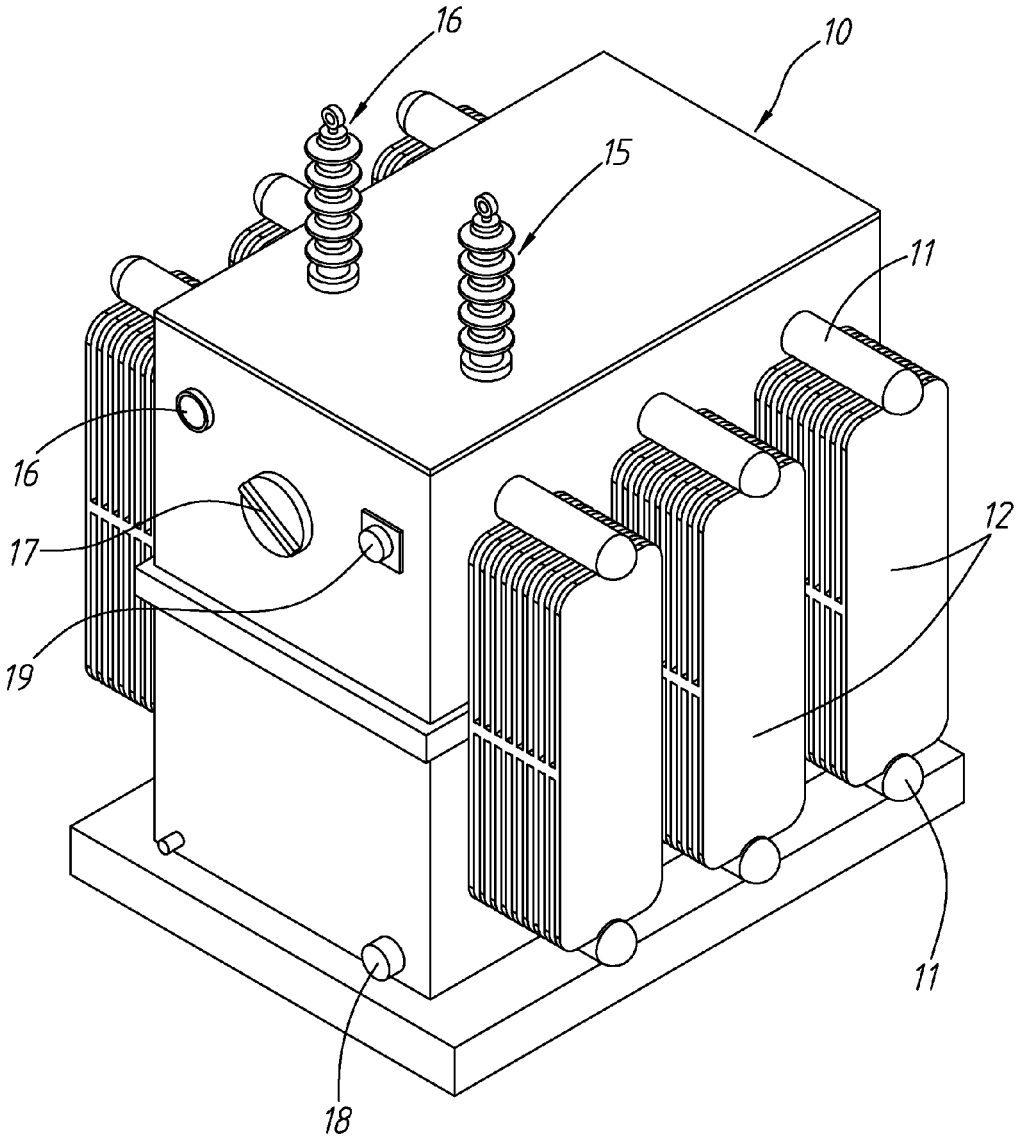
FIG. 1 PRIOR ART
FIG. 1 is an oblique top elevational view of an economizer according to the prior art.
Figure 2:
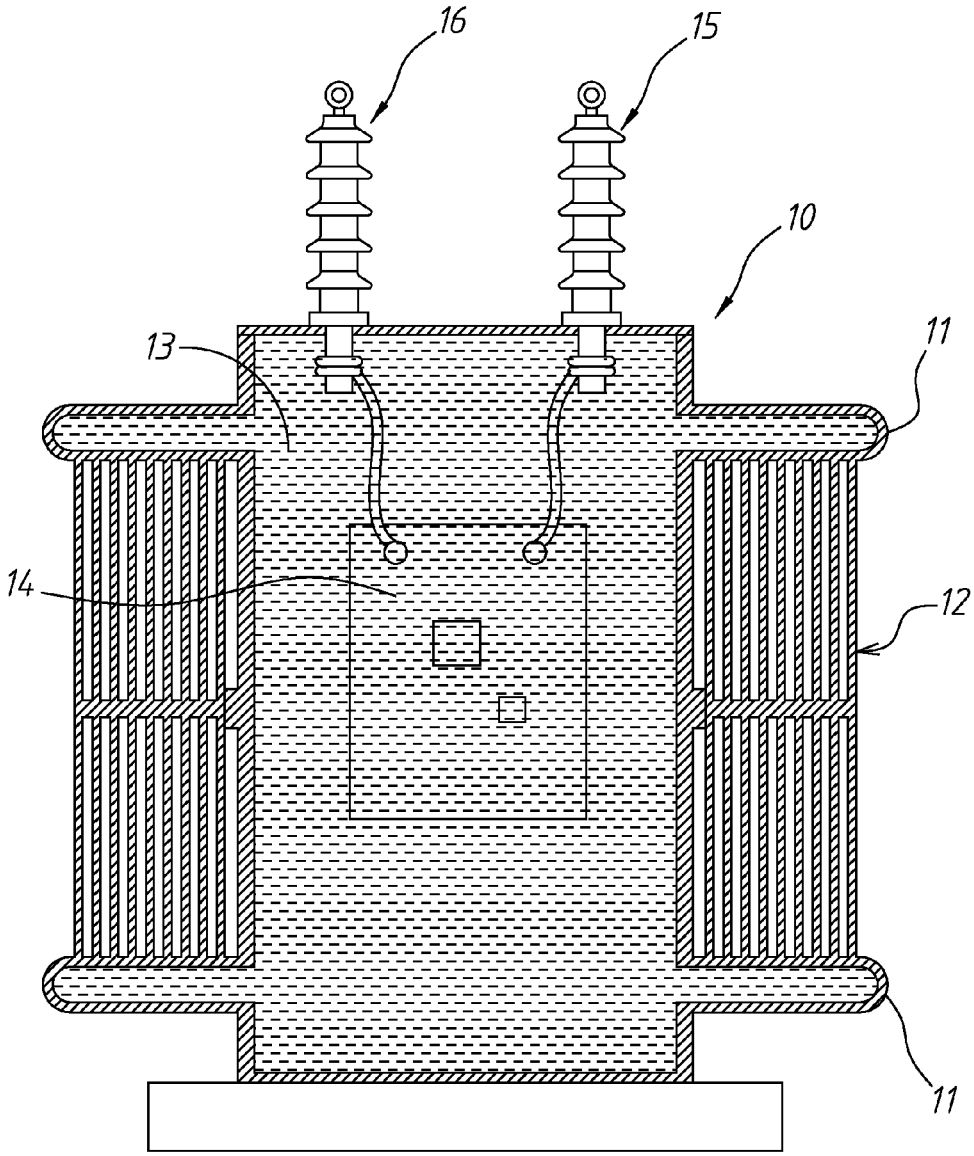
FIG. 2 PRIOR ART
FIG. 2 is a sectional view of the prior art economizer shown in FIG. 1.
Figure 3:
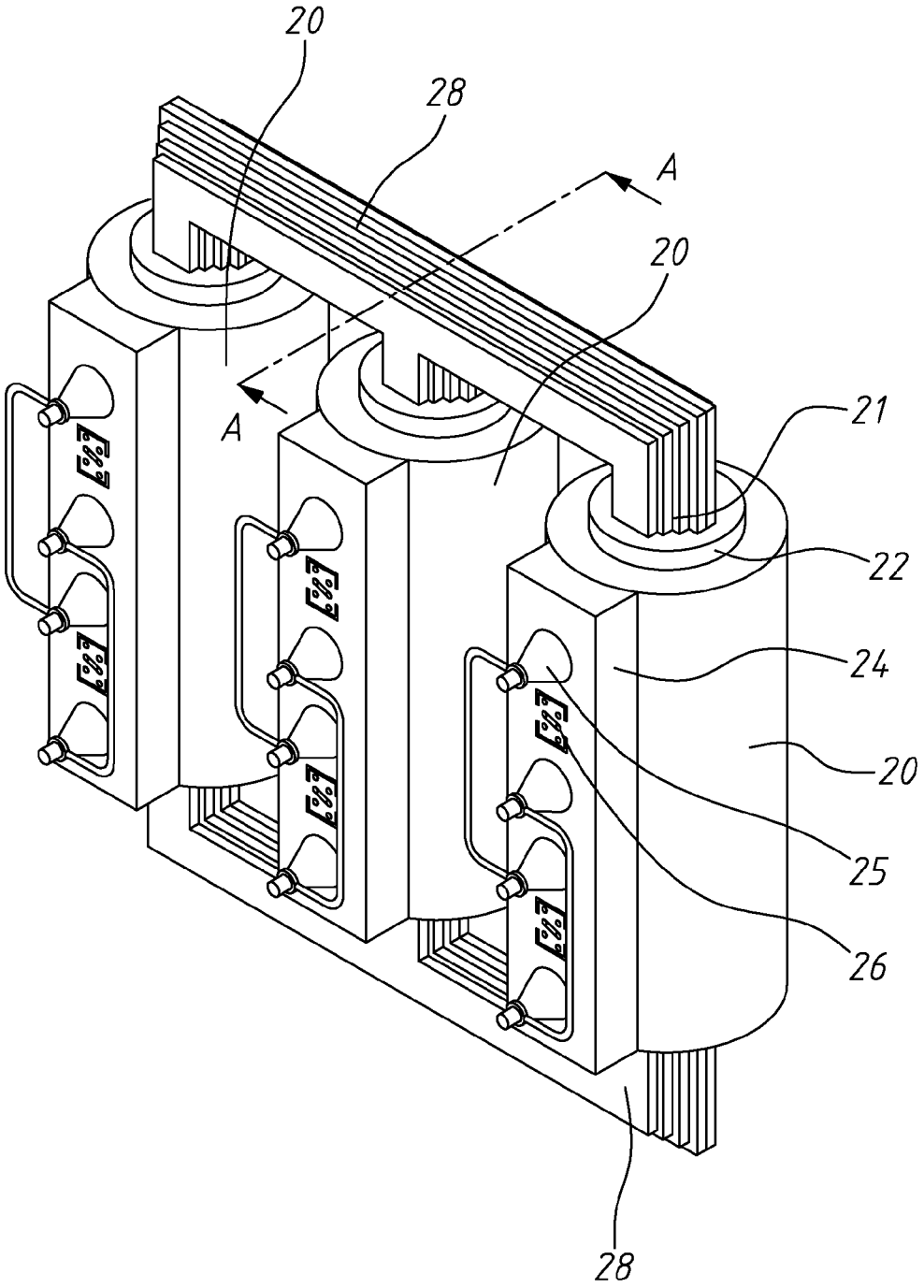
FIG. 3 is an oblique top elevational view of a dry type economizer in accordance with the present invention.
Figure 4:
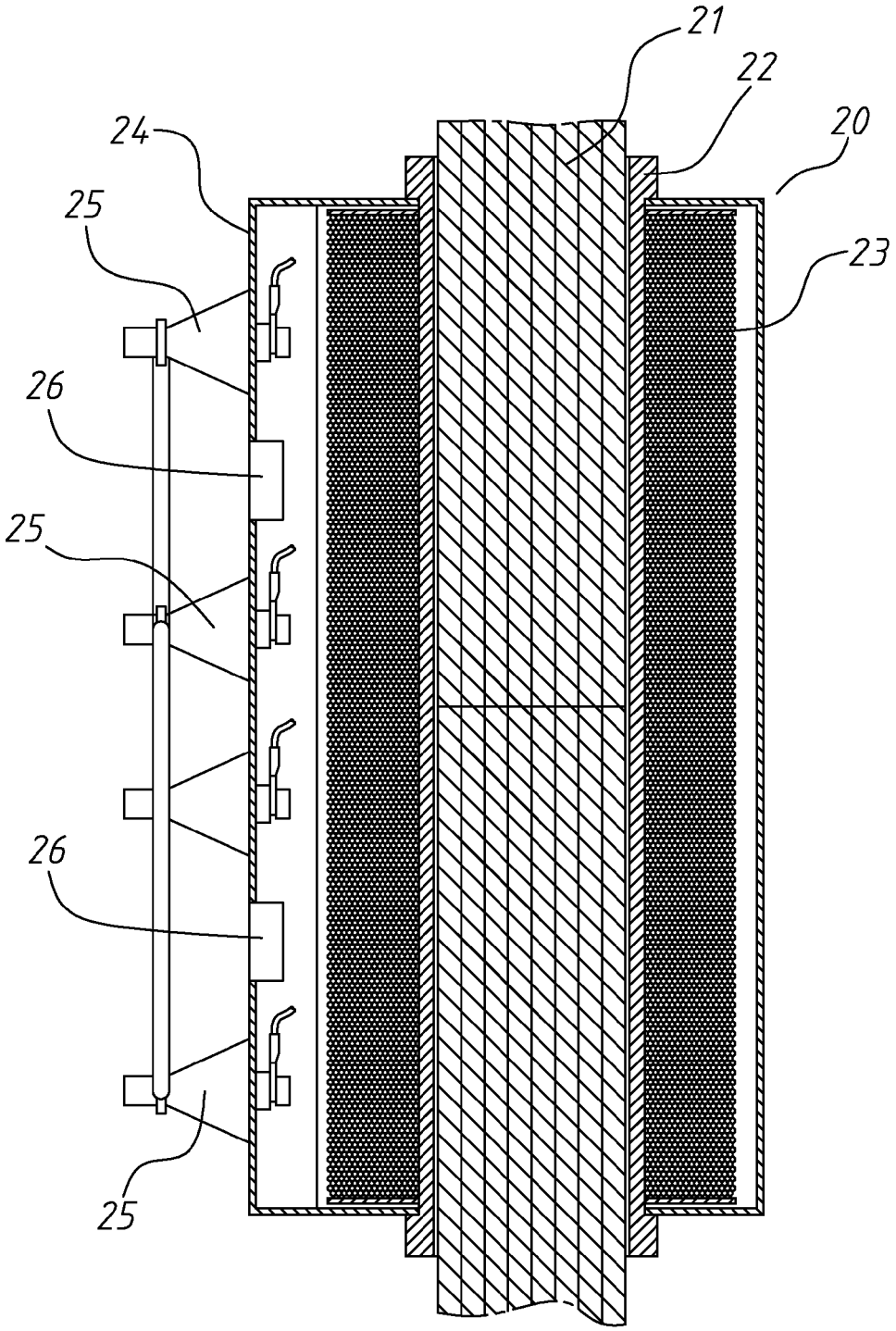
FIG. 4 is a sectional view taken along line A-A of FIG. 3.

Referring to FIGS. 3 and 4, an economizing unit for dry type economizer in accordance with the present invention is shown. The economizing unit comprises a plurality of bodies 20 in a particular size. In this embodiment, the bodies 20 have a cylindrical shape to increase the surface contact area with the atmosphere. However, this cylindrical shape is for the purpose of illustration only, but not intended for use to restrict the claims of the invention.

Each body 20 comprises a silicon-steel layer 21, an insulating layer 22 surrounding the silicon-steel layer 21, and a plurality of windings 23 surrounding the insulating layer 22. The windings 23 are intended for use to energize reactance elements and reactance filter converters. The invention increases the wire diameter of the windings 23 to reduce resistance and heat. In most conventional economizers, a 3.5 mm wire material is used to make the winding. In this embodiment of the present invention, a 5.25 mm wire material is used to make the windings 23. The increasing rate in wire diameter is preferably within the range of 50%~60%.

When the wire diameter of the windings 23 is increased, the volume of the body 20 must be relatively increased to accommodate the windings 23 and to provide a relatively larger surface area for contact with the atmosphere for quick dissipation of heat.

As illustrated, each body 20 has an external fitting component arranged on the outside for the mounting of reactance elements and reactance filter converters. This external fitting structure can be formed integral with the body 20, or made detachable. In this embodiment, the external fitting structure comprises an elongated flange 24 located at the periphery thereof at one side, a plurality of reactance element input/output casings 25 mounted in and equally spaced along the length of the elongated flange 24, and a plurality of filter converter devices 26 mounted in the elongated flange 24 and respectively disposed between each two adjacent reactance element input/output casings 25 for use as reactance filter converters. The reactance element input/output casings 25 and the filter converter devices 26 are electrically connected together. Further, the reactance element input/output casings 25 and the filter converter devices 26 are electrically connected to the respective windings 23. Thus, input current passing through this economizing unit can be optimized for energy efficiency.

The economizing unit further comprises two silicon-steel beams 28 transversely disposed at opposing top and bottom sides relative to the bodies 20 and respectively connected with opposing top and bottom ends of the silicon-steel layers 21 of the bodies 20. Preferably, the top and bottom ends of the silicon-steel layers 21 of the bodies 20 are partially connected to the silicon-steel beams 28. Stamping silicon-steel plates into a predetermined shape and then stacking up shaped silicon-steel plates makes the silicon-steel structure of the silicon-steel layers 21 and silicon-steel beams 28.

Figure 5:
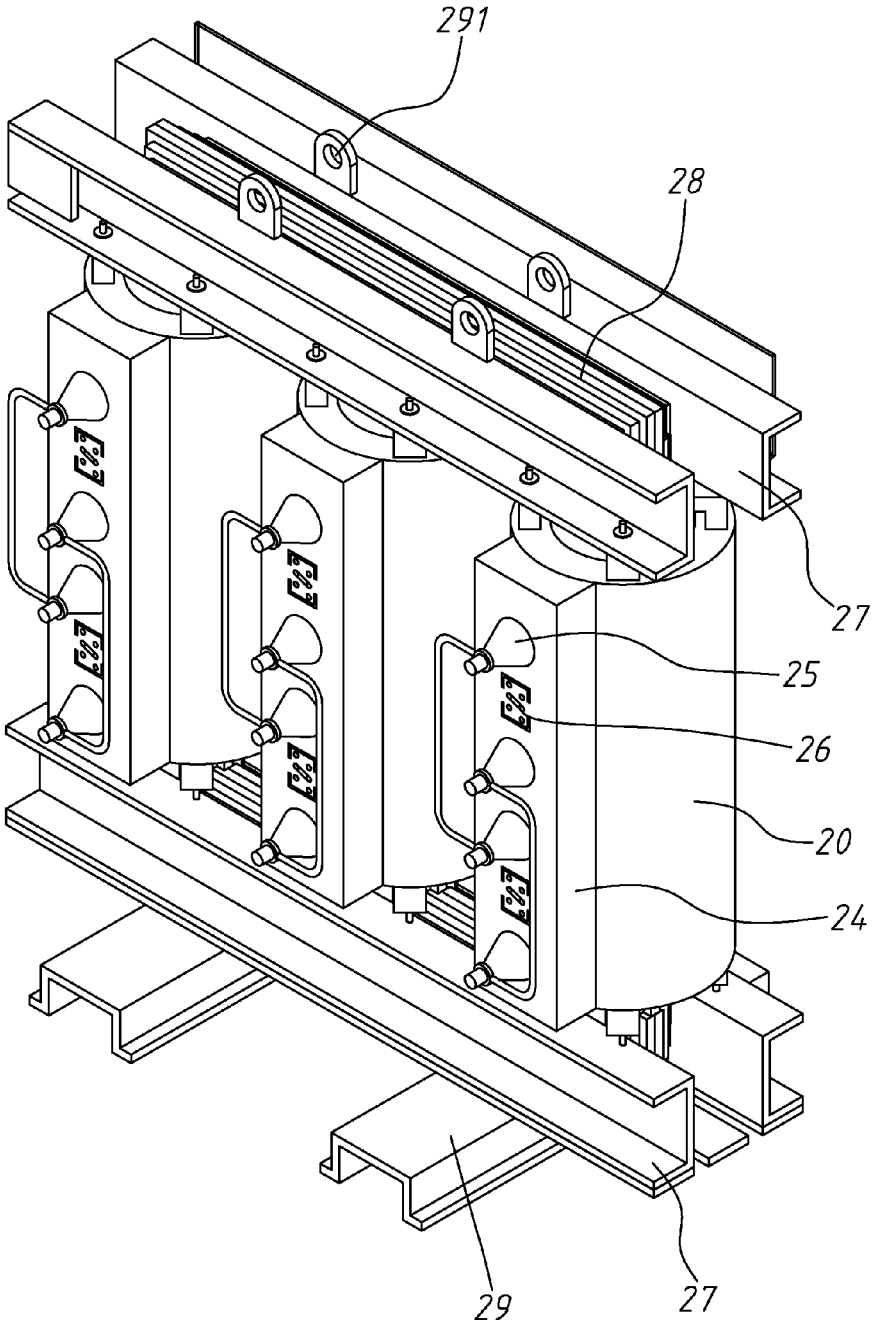
FIG. 5 corresponds to FIG. 3, illustrating two silicon-steel beams and a bottom bracket installed in the economizing unit at opposing top and bottom sides of the bodies.
Figure 7:
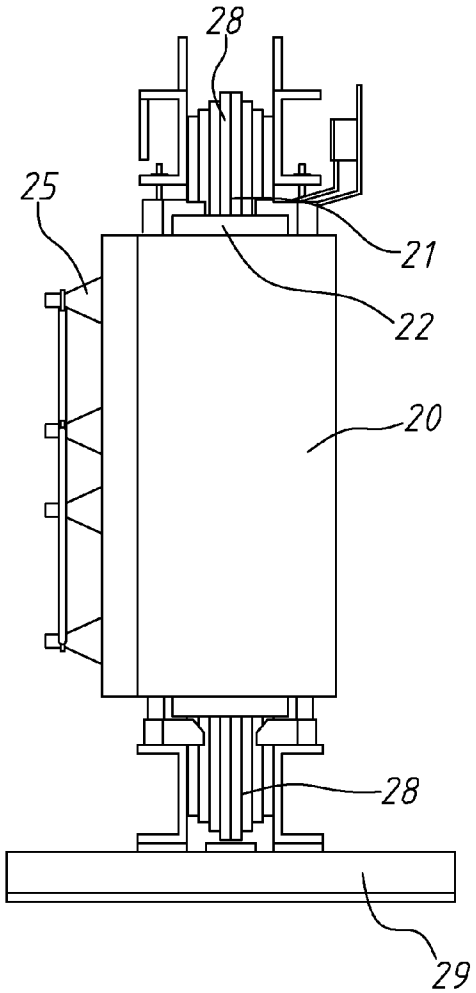
FIG. 7 is a side view of FIG. 5.
Figure 6:
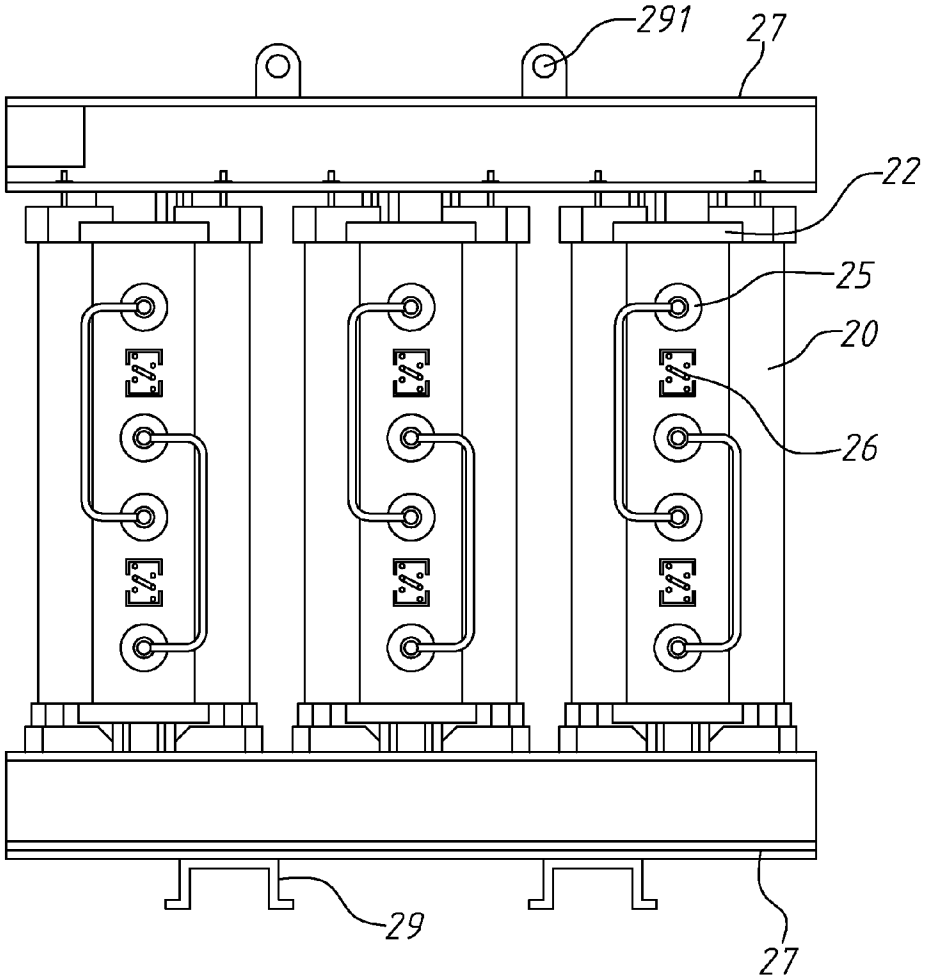
FIG. 6 is a front view of FIG. 5.

Referring to FIGS. 5-7, each economizer unit further comprises two combination brackets 27 respectively mounted at opposing top and bottom sides of the bodies 20 and at opposing front and rear sides of the silicon-steel beams 28, a plurality of lifting lugs 291 affixed to the combination bracket 27 at the top side of the bodies 20, and a bottom bracket 29 affixed to the combination bracket 27 at the bottom side of the bodies 20. The arrangement of the lifting lugs 291 and the bottom bracket 29 allows a forklift or hoist to carry the whole equipment to the desired place and location.

By means of increasing the wire diameter of the windings and the volume of each body of each economizing unit, the surface area of the bodies of each economizing unit of the economizer of the invention that is kept in contact with the atmosphere is greatly increased for quick dissipation of heat during operation of reactance elements. Therefore, the invention eliminates the use of any insulating oil and other related components, such as drain valves and oil level meters, preventing the internal components from degradation.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A dry type economizer comprising at least one economizing unit, each said economizing unit comprising:

a plurality of bodies, each body of said plurality of bodies comprising a silicon-steel layer, an insulating layer surrounding said silicon-steel layer, and a plurality of windings surrounding said insulating layer and adapted for energizing reactance elements and reactance filter converters, each said winding being formed of a wire material having an increased wire diameter larger than a standard wire diameter of 3.5 mm;

two silicon-steel beams respectively mounted at opposing top and bottom sides of said bodies and connected with opposing top and bottom ends of the silicon-steel layers of said bodies; and a plurality of elongated flanges, one elongated flange of said plurality of elongated flanges being located on one side of a periphery of each body of said plurality of bodies, a plurality of reactance element input/output casings mounted in and equally spaced along a length of each said elongated flange of the plurality of elongated flanges, and a plurality of filter converter devices mounted in each said elongated flange of the plurality of elongated flanges, an uppermost filter converter device of said plurality of filter converter devices is located between an uppermost pair of reactance element input/output casings of said plurality of reactance element input/output casings and a lowermost filter converter device of said plurality of filter converter devices is located between a lowermost pair of reactance element input/output casings of said plurality of reactance element input/output casings for use as reactance filter converters.

2. The dry type economizer as claimed in claim 1, wherein the increasing rate in wire diameter of said windings is preferably within the range of 50%~60% when compared to said standard wire diameter of 3.5 mm.

3. The dry type economizer as claimed in claim 1, wherein said plurality of reactance element input/output casings are equally spaced in a vertical line.

4. The dry type economizer as claimed in claim 1, wherein said plurality of reactance element input/output casings and said plurality of filter converter devices are electrically connected in such a manner that said plurality of reactance element input/output casings and said plurality of filter converter devices are respectively and electrically connected to the windings of a corresponding body of said plurality of bodies.

* * * * *